US010597893B2

(12) United States Patent
Tersigni

(10) Patent No.: US 10,597,893 B2
(45) Date of Patent: Mar. 24, 2020

(54) BRACE FOR A POST

(71) Applicant: Cindon Developments, Inc., East Caledon (CA)

(72) Inventor: Donato Tersigni, East Caledon (CA)

(73) Assignee: Cindon Developments, Inc., Ontario (CA)

( * ) Notice: Subject to any disclaimer, the term of this patent is extended or adjusted under 35 U.S.C. 154(b) by 0 days.

(21) Appl. No.: 16/033,388

(22) Filed: Jul. 12, 2018

(65) Prior Publication Data

US 2019/0376308 A1 Dec. 12, 2019

(30) Foreign Application Priority Data

Jun. 11, 2018 (CA) ..... 3007794

(51) Int. Cl.
*E04H 12/22* (2006.01)
*E04H 12/00* (2006.01)

(52) U.S. Cl.
CPC ..... *E04H 12/2292* (2013.01)

(58) Field of Classification Search
CPC ..... E04H 12/2215; E04H 12/2292; E04H 12/2269
USPC ..... 52/834, 835
See application file for complete search history.

(56) References Cited

U.S. PATENT DOCUMENTS 574,641 A * 1/1897 Streator ..... E04H 12/2292 52/302.5
731,752 A * 6/1903 Cadwell ..... E04H 12/2292 52/295
1,710,842 A * 4/1929 Salustri ..... E04G 7/20 403/312
2,989,329 A * 6/1961 Noah ..... A47B 9/20 403/107
3,161,722 A * 12/1964 Wellens ..... H02G 3/0418 138/155
3,413,775 A * 12/1968 Katz ..... E04F 13/0885 52/254
4,516,365 A * 5/1985 Chapman ..... E04H 12/2292 52/170
4,543,757 A * 10/1985 Cosgrove ..... E02D 27/42 248/158
4,697,957 A * 10/1987 Hellmers ..... E02D 5/60 405/212
4,759,161 A * 7/1988 Kucyk, Jr. ..... E01F 9/635 404/10
5,335,471 A * 8/1994 Kupiec ..... E01F 15/003 248/218.4

(Continued)

FOREIGN PATENT DOCUMENTS

EP 0173446 A1 * 3/1986 ..... B29C 65/3436
GB 190614393 A * 11/1906 ..... A01G 17/14
WO WO-2011011834 A1 * 2/2011 ..... A01G 17/14

*Primary Examiner* — Patrick J Maestri
*Assistant Examiner* — Joseph J. Sadlon
(74) *Attorney, Agent, or Firm* — Anthony J. Bourget

(57) ABSTRACT

A method, system and brace for retaining a post having a pair of associated cooperatively engaging brackets defining opposing and aligning openings disposed midway along each bracket. A transverse retainer is associated with and insertable within midway the brackets for resting the post thereupon when the brackets embrace the post. The brace further defines opposing and aligning openings disposed within an upper portion of each bracket for receiving fasteners therethrough to retain the post within the brace.

19 Claims, 4 Drawing Sheets

(56) References Cited

U.S. PATENT DOCUMENTS 5,661,946 A * 9/1997 Davis ..... E04H 12/04 248/219.2
5,832,675 A * 11/1998 Zuares ..... E04H 12/2292 52/60
6,601,362 B1 * 8/2003 Prince ..... E04C 3/06 52/844
6,786,017 B2 * 9/2004 Thompson ..... E04B 2/7433 248/519
6,821,050 B1 * 11/2004 Maldonado ..... E01F 13/046 404/6
6,826,885 B2 * 12/2004 Raskin ..... E04C 3/06 403/393
D521,656 S * 5/2006 Terrels ..... E04C 3/06 D25/122
7,717,641 B2 * 5/2010 Stice ..... E01F 13/046 404/73
7,866,120 B2 * 1/2011 Prenn ..... E04H 12/2292 52/169.13
8,297,873 B1 * 10/2012 Schram ..... E01F 9/685 40/607.01
8,573,565 B1 * 11/2013 Lyndaker ..... A63B 71/0054 256/23
8,915,045 B2 * 12/2014 Eaves ..... E02D 27/42 248/158
9,010,069 B2 * 4/2015 Bernard ..... E04H 12/2292 52/844
9,032,694 B2 * 5/2015 Bernard ..... E04H 12/2292 52/844
9,085,915 B1 * 7/2015 Emmett ..... E04H 12/2292
9,126,289 B2 * 9/2015 Herman ..... B23K 31/02
9,206,581 B2 * 12/2015 Mollick ..... E02D 27/32
9,359,785 B2 * 6/2016 Catt ..... A01G 17/14
9,816,281 B2 * 11/2017 Angelo ..... E04G 23/0229
9,909,271 B2 * 3/2018 Wiegel ..... E01F 9/646
10,358,838 B2 * 7/2019 Dominguez ..... E04H 12/2269
2003/0163960 A1 * 9/2003 Hadden ..... E04C 3/30 52/170
2006/0185270 A1 * 8/2006 Handley ..... E04C 3/30 52/169.14
2010/0176543 A1 * 7/2010 Burke ..... E04H 12/2292 267/153
2019/0284828 A1 * 9/2019 Benton ..... E04H 12/2269

* cited by examiner

BRACE FOR A POST

TECHNICAL FIELD

The present invention pertains to methods, systems and apparatus for installing and bracing posts within ground, and more preferably wooden posts.

BACKGROUND OF THE INVENTION

Posts are utilized for a variety of structures including fences, gates, mailbox posts, signposts, and tree and vine stakes. Because wooden posts are subject to seasonal wet and dry cycles, the wooden posts eventually rot. Rot is a result of microbial and insect activity, and is hastened by moisture. There are various known methods to secure wooden posts within the ground, including concrete and ground spikes, however, none of the methods or apparatus sufficiently address the problem of wood rot, easy replacement of damaged posts or the inherent irregularity in the shape of wooden posts. Each of these problems is described in more detail below.

Delaying Rot

One method to delay rot is to utilize more rot-resistant wood, such as cedar (which has a longer lifespan). Other types of wood require chemical treatment to preserve the wood. Chemical preservatives can be applied to wood by brushing, spraying or dipping. Pressure-treated wood, wherein the wood is impregnated with chemical preservatives, offers improved resistance to damage from microbes and insects. Even pressure-treated woods eventually rot as the chemical preservative leaches out into the surrounding earth. In addition, due to environmental concerns, some highly effective chemical preservatives have been banned and are no longer in use.

It is also known to prevent rot by preventing contact between earth and the wooden post. For example, various post collars made of plastic or metal are available. These post collars are designed to wrap around a wood post at or around ground level, however, known post collars do not always provide a good fit between the collar and the wooden post such that moisture, microbes and insects are kept away.

Irregularity of Wooden Posts

To illustrate the point above, consider that for any particular preservative, whether applied with pressure or not, different types of wood react differently. For example, some wood absorbs more preservative than other wood, thereby causing greater expansion of the wood upon treatment. In addition, wooden posts are often stacked in bundles for the purposes of easy transportation. The wooden posts within the bundles dry out unevenly and can warp if not stacked and handled carefully.

In addition, the milling process to create the wooden posts is not perfect, nor is the wood making up the post, and there is a regulated tolerance of ⅛". Combining this imperfect milling process with the different reactions of various woods to preservative treatment and the possible warping of posts during any of transport, storage, and display, means that wooden posts vary in dimension along their length. Thus it may be difficult to get a good fit between the wooden post and a post collar such that moisture, microbes and insects are kept away.

Installation and Replacement

There are various known ways to secure fence posts within the ground. One example is concrete. Use of concrete requires use of an auger to drill a relatively large hole to accommodate the post as well as the concrete. Once the concrete is added, the post must be stabilized until the concrete has set. Replacing a damaged post requires removing all of the concrete as well as the post. In addition, concrete is porous and does not prevent the wood from rotting. If and when a damaged wooden post requires replacement, the concrete and damaged post must be removed and replaced.

Another common way to set up wooden posts is within structures such as ground spikes. An advantage of ground spikes is that there is no need to prepare a post hole since the ground spikes can be hammered directly into the ground. There is also no need to secure the ground spike with concrete. Ground spikes often include a cuff for affixing to the lower end of a wooden post, which can make it easy to replace a damaged post, however, posts attached to ground spikes lack stability when compared to posts that have been inserted into ground and secured by concrete. Another disadvantage of ground spikes is it can be difficult to get the spikes level. If the spike is not level, it necessitates removing and hammering the spike in again or planing the bottom of a post.

Another factor to consider is the climate in which the posts will be utilized. As discussed above, moisture is an important issue, however, so is temperature. For example, in colder climates, if a wooden post is inserted into the ground above the frost line, the ground will heave and posts can be dislodged from their original position within the ground.

In cases where the wooden post is affixed or inserted into a structure such as a ground spike, then the ground spike must be inserted to a sufficient depth so that the wooden post can be removed from the structure without dislodging the structure from its position within the ground.

The relevant prior art lacks systems, methods and apparatuses that secure wooden posts in the ground while also deterring wood rot, and which permit easy installation and easy replaceability of posts while simultaneously aiding access to the fenced area.

SUMMARY OF THE INVENTION

The present invention is a brace for retaining a post comprising a pair of associated cooperatively engaging brackets defining opposing and aligning openings disposed midway along each bracket with an associated transverse retainer insertable within midway the brackets for resting the post thereupon when the brackets embrace the post, and further opposing and aligning openings disposed within an upper portion of each bracket for receiving fasteners therethrough to retain the post.

In another embodiment, the present invention is a method of installing a wooden post in a ground hole comprising the steps of providing a brace in accordance with the above, wrapping the brace around the wooden post and inserting the brace into a ground hole wherein the upper portion of the brace remains above grade, and securing the wooden post to the brace by inserting fasteners through the openings in the upper portion of each bracket while the post rests atop the transverse retainer and beneath grade.

In another embodiment, the present invention is a system for bracing a post comprising two opposing reciprocally mating brackets to encompass the post. The brackets each define two pre-positioned sets of openings to allow bolts to pass therethrough, wherein upon mating the brackets around the post, the first set of openings align and oppose each other near midway along the brackets for allowing a first bolt to pass therethrough, and the second set of openings align and oppose each other near a second end portion of the mating brackets to allow a second bolt to pass therethrough. The first bolt at the first set of openings supports the post thereon within the ground and defines an air column extending from beneath the post and bolt to a first end portion of the mating brackets, the first bolt and the mating brackets first end portion both being beneath grade. The second bolt at the second set of openings bolting into and retaining the post, with all of the second set of openings, the second bolt, and the mating brackets second end portion being above grade.

DETAILED DESCRIPTION

Figure 4:
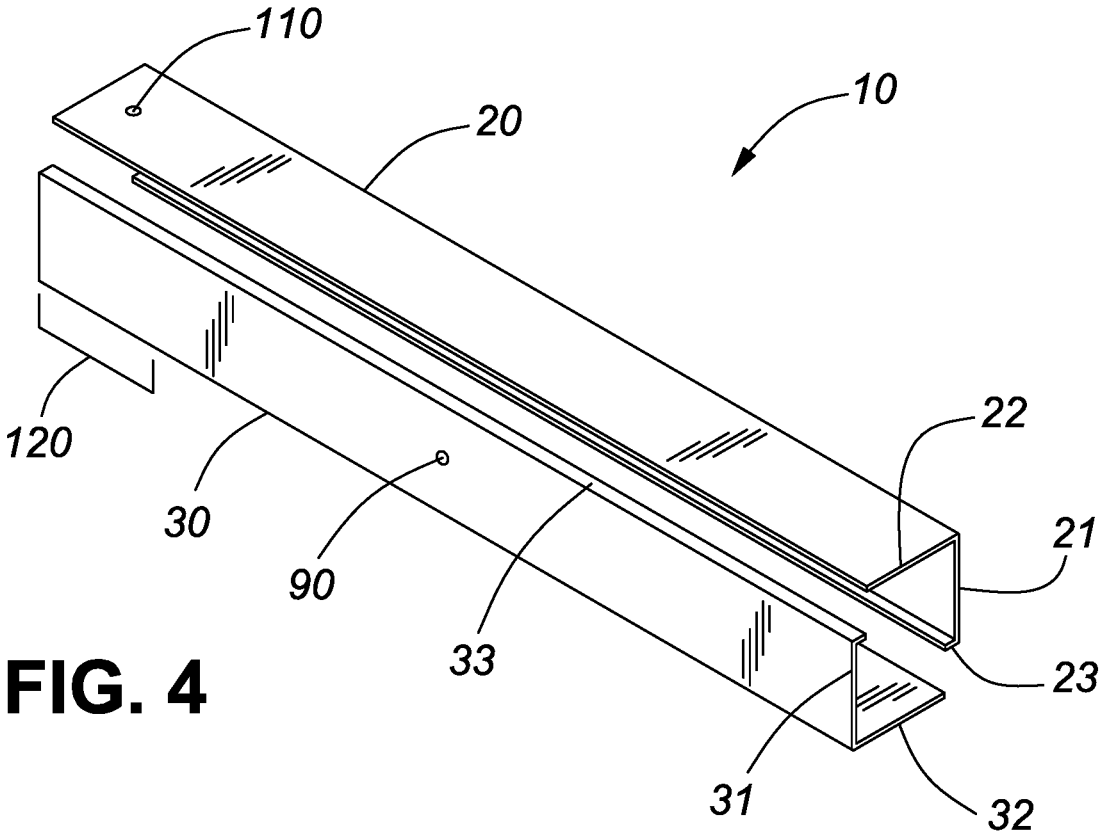
FIG. 4 is a perspective view of two elongated brackets.
Figure 4A:
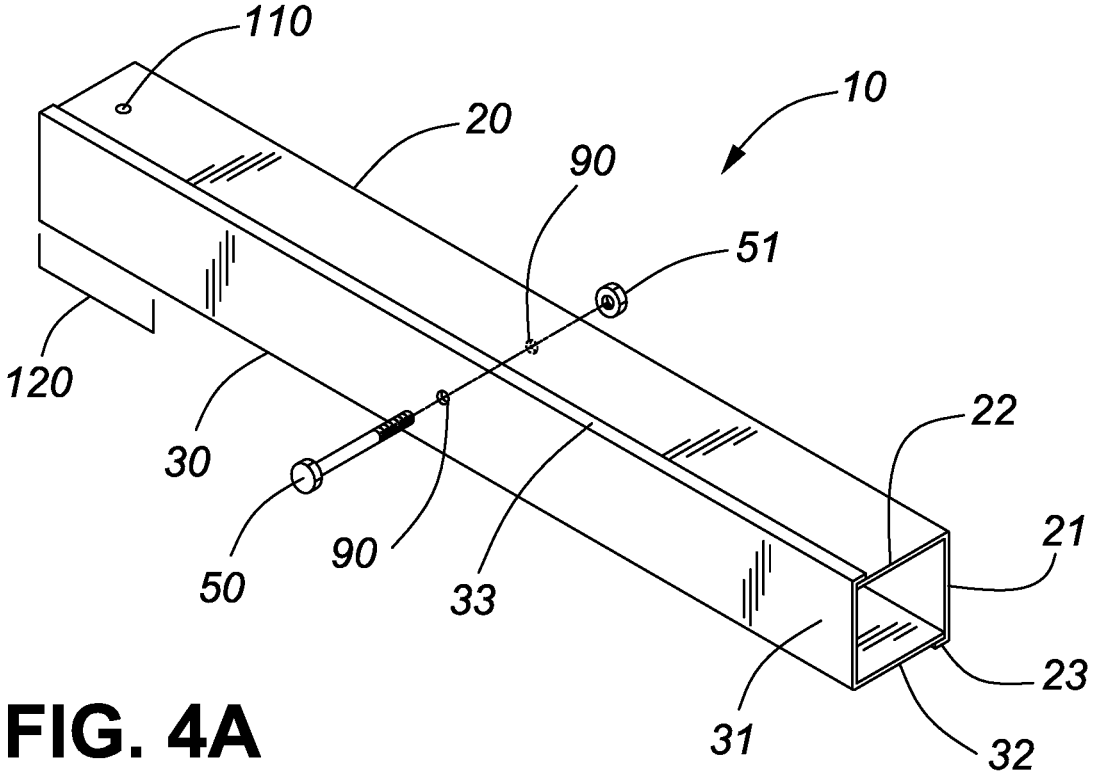
FIG. 4A is a perspective view of two elongated brackets assembled to form a brace.

As shown in FIGS. 4 and 4A, the brace 10 described herein is comprised of a pair of elongated brackets 20 and 30. Bracket 20 is identical to bracket 30. The first bracket 20 cooperatively engages the second bracket 30, to form a brace or sleeve 10, into which a wooden post 40 can be inserted. See FIG. 7 for a view of wooden post 40 inserted within brace 10. By forming the brace 10 from two pieces, the present invention is able to accommodate the inherent irregularities present in wooden posts, previously discussed.

Figure 1:
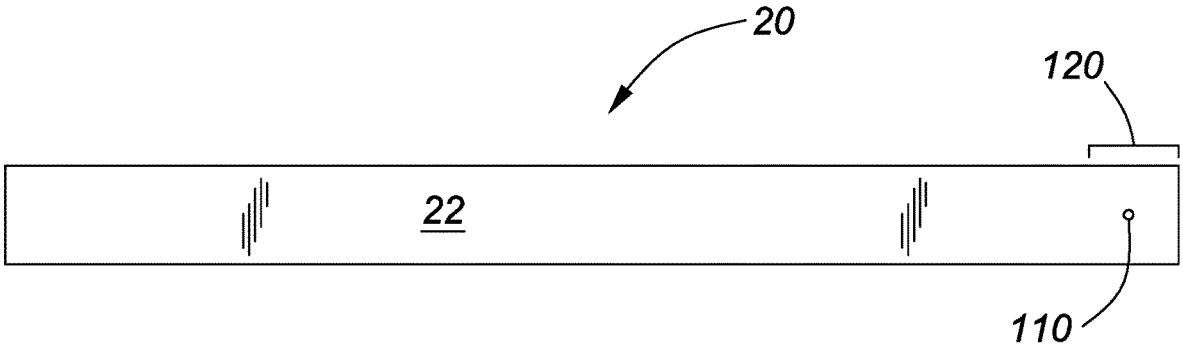
FIG. 1 is a plan view of an elongated bracket according to the present invention.
Figure 2:
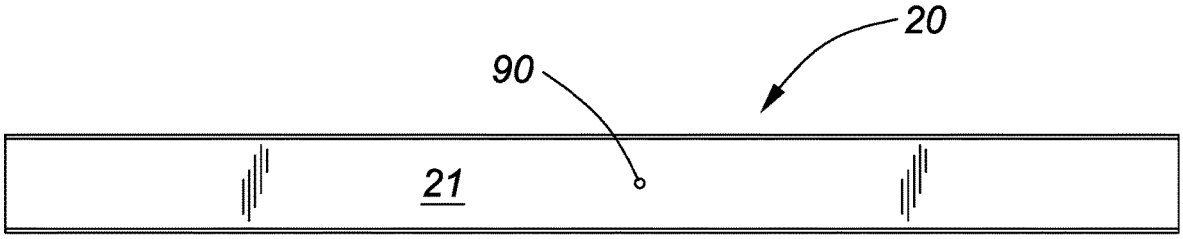
FIG. 2 is a second plan view of the elongated bracket.
Figure 3:
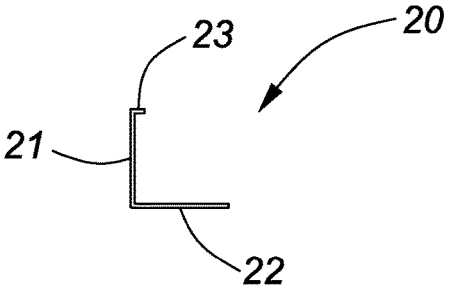
FIG. 3 is a plan view of an end of the elongated bracket.

The brackets 20 and 30 themselves can be of different shapes to accommodate different shaped wooden posts. For example, to enclose a quadrilateral wooden post each bracket 20 and 30 has a J-shaped cross-section. See FIG. 3 for a cross section of elongated bracket 20, which is identical to elongated bracket 30. Bracket 20 is comprised of a first wall 21 having a top edge and a bottom edge, a second wall 22 extends orthogonally from the bottom edge and a lip 23 extends orthogonally from the top edge. FIG. 1 provides a view of second wall 22. An opening 110 is located in an upper portion 120 of second wall 22. FIG. 2 provides a view of first wall 21. Opening 90 is located in a middle portion of first wall 21.

Figure 5:
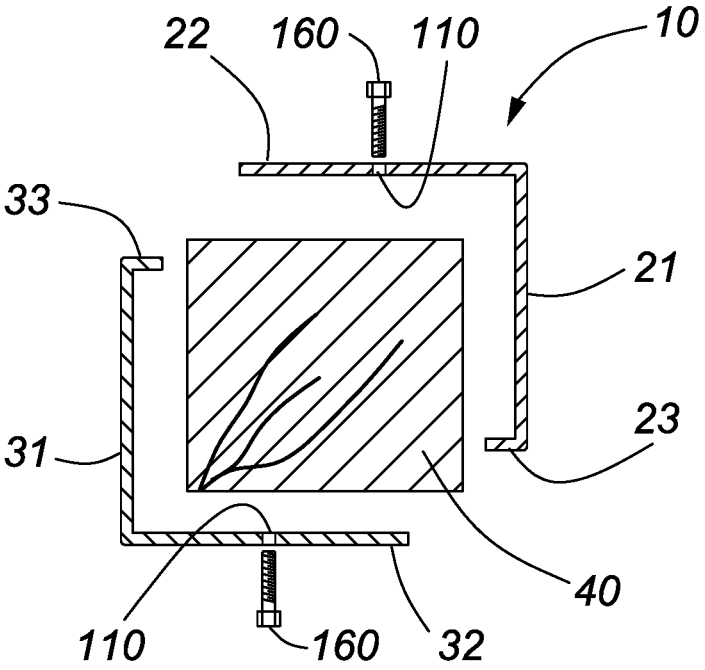
FIG. 5 is an cross sectional view of two elongated brackets and a wooden post prior to assembly into the brace.
Figure 6:
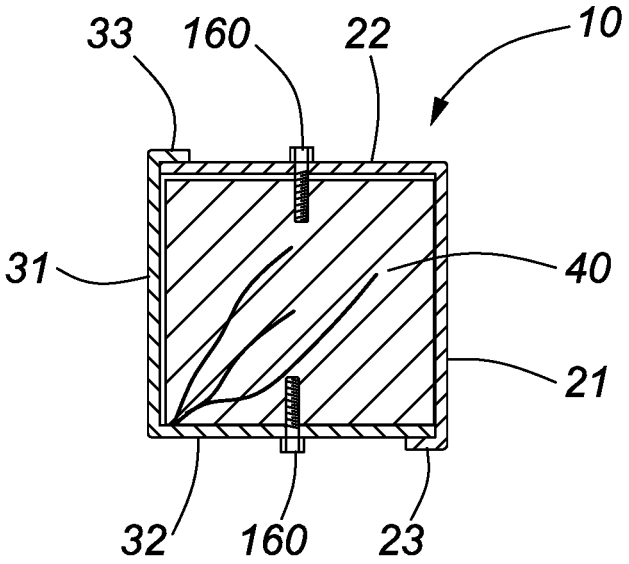
FIG. 6 is a cross sectional view of an assembled brace and a wooden post.

As previously described, brace 10 is comprised of two elongated brackets 20 and 30. Identical to elongated bracket 20, second bracket 30 is comprised of a first wall 31 having a top edge and a bottom edge, a second wall 32 extending orthogonally from the bottom edge and a lip 33 extending from the top edge (see FIG. 4 for example). Upon assembly, viewed in FIGS. 4A and 6, the lip 23 of first bracket 20 overlaps the second wall 32 of second bracket 30, and the lip 33 of second bracket 30 overlaps the first wall 21 of first bracket 20. In addition, openings 90 and 110 in brackets 20 and 30 oppose one another. See FIG. 4A for openings 90 and FIGS. 5 and 6 for openings 110.

To accommodate a circular or ovoid wooden post, the brackets can be arcuate in shape.

The brackets 20 and 30 can be composed of a preferrably rust-resistant material, such as aluminum, titanium, plastic, and galvanized metal.

Once the brackets 20 and 30 are brought together as shown in preferred embodiment in FIG. 4A for a quadrilateral wooden post, a transverse retainer 50 is inserted within the brace 10.

The transverse retainer 50 provides three functions. The first function is to secure the brackets 20 and 30 with one another. The second function is to provide a surface upon which the wooden post 40 rests, which provides a column of air (not shown) between the bottom 70 of the wooden post 40 and the ground 80 into which the brace 10 and post 40 are inserted (see FIG. 7). The third function is to save on materials. An end-user of the present invention can use shorter wooden posts since the brace portion below the transverse retainer 50 acts as an extension for wooden post 40.

In a preferred embodiment, the transverse retainer comprises a bolt 50 secured by a nut 51 (see FIG. 4A). As previously described, the brackets 20 and 30 define openings 90 for receiving the bolt 50 (see FIGS. 2, 4 and 4A). The openings 90 are disposed within a middle portion of elongated brackets 20 and 30, however, the openings 90 can be located anywhere along the brackets as long as the wooden post is prevented from contacting the ground under the brace.

Figure 7:
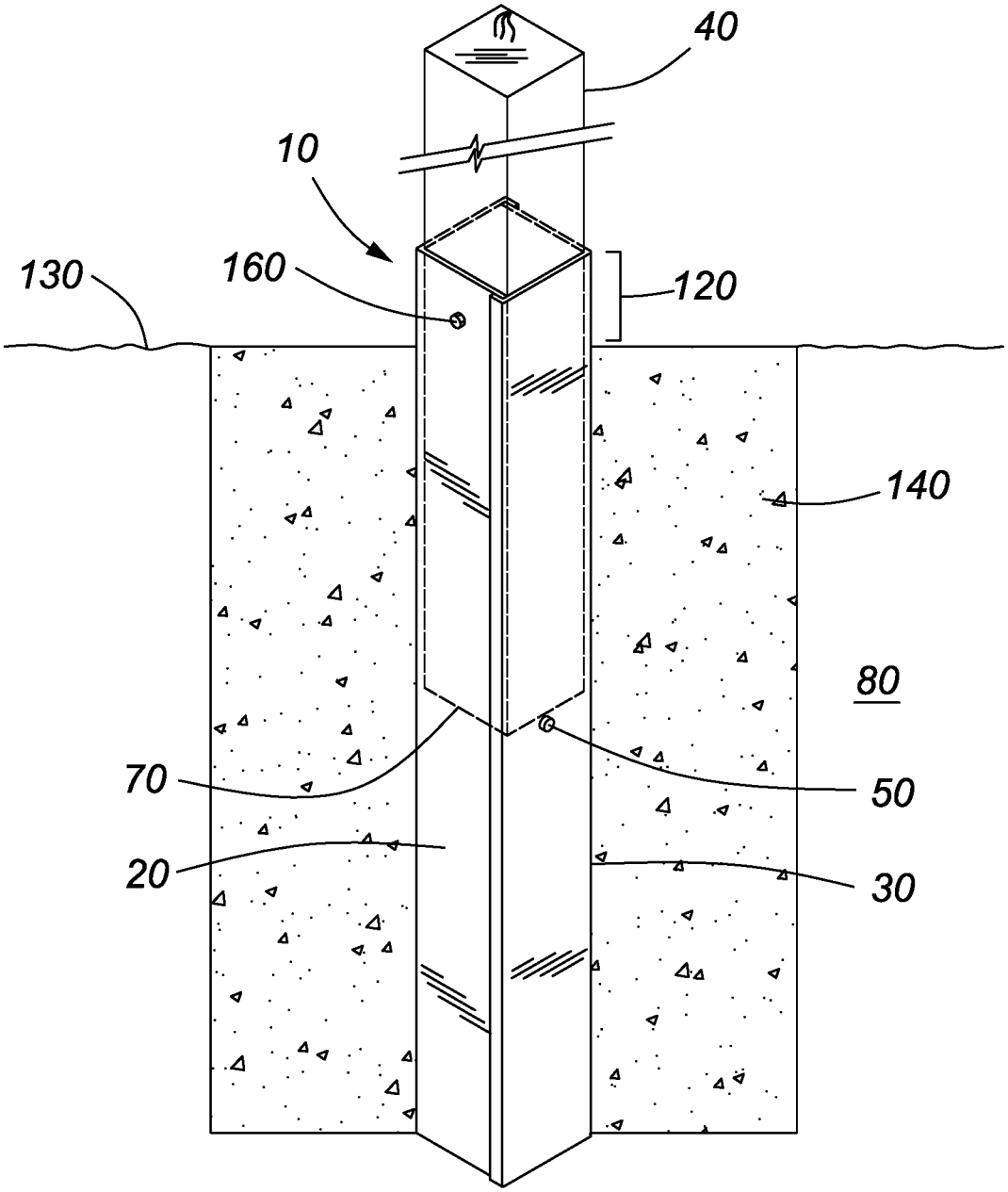
FIG. 7 shows an assembled brace and wooden post inserted within ground.

Once the wooden post 40 is inserted within the brace 10, the wooden post 40 is secured within the brace 10. In a preferred embodiment, this is accomplished by providing opening 110 within an upper portion 120 of each bracket 20 and 30 (FIG. 1, FIG. 4, FIG. 4A, and FIG. 5 and FIG. 7). The wooden post 40 is secured to the brace 10 by inserting a screw, bolt or other wood fastener 160 within openings 110. See FIGS. 5 and 6 in particular. As shown in FIG. 7, the upper portion 120 is situated above the ground surface (above grade) 130 so that the openings 110 are easily accessible for securing, removing and replacing a wooden post 40 within the brace 10.

In practice, a hole is made in the ground using an auger for example, to receive an assembled brace 10. Prior to insertion into the ground, the first and second brackets 20 and 30 are brought together and secured to one another using a bolt and nut (50 and 51) or other means through openings 90. A wooden post 40 is then inserted into the brace 10 and secured within the brace 10 by inserting fasteners 160 through openings 110. The brace 10 and wooden post 40 are then inserted into the prepared hole taking care to ensure that the fasteners 160 are situated above ground level 130 in order to ensure accessibility. Concrete 140 is then poured around the brace 10 to secure the brace/wooden post within the ground.

In order to replace a damaged wooden post or gain access to a fenced area, all that is required is to remove the fasteners 160 at the upper portion 120 of the brackets 20 and 30, which is accessible above the ground 130 and then remove the damaged wooden post 40 from the brace 10. A new wooden post can then be inserted into the brace and re-secured with fasteners. The same applies if the post is removed only temporarily, and then re-assembled into the brace.

What is claimed is:

1. A system for bracing a post having a bottom surface, the system comprising;

two opposing reciprocally mating brackets configured to encompass the post, the brackets defining a first end portion and second end portion, and a middle portion disposed between the first and second end portions;

a first set of opposing and alignable openings disposed in the middle portion of the brackets;

a second set of openings disposed near the second end portion of the bracket;

wherein upon mating the brackets the first set of openings align and oppose each other to allow a first fastener to pass therethrough, and the second set of openings align and oppose each other to allow a second fastener to pass through at least one opening of the second set of openings; and the first fastener at the first set of openings configured to support the bottom surface of the post to be positioned thereon within the ground and defining an air column extending from and beneath the first fastener to the first end portion of the mating brackets, the first fastener and the mating brackets first end portion both being beneath grade.

2. The system of claim 1 wherein the first fastener is any one of a screw and bolt.

3. The system in claim 1 wherein the brackets define any shape selected from the group comprising j-shaped, semi-square, tri-laterally sided, semi-rectangular, semi-circular, arcuate, semi-oval, and angled.

4. The system in claim 1 wherein the post is made from any material selected from the group comprising wood and composite fiber.

5. The system in claim 1 wherein the brackets are made from any material selected from the group comprising aluminum, galvanized metal, titanium, and plastic.

6. The system of claim 1 wherein the first fastener is configured to span the two brackets.

7. The system of claim 1 wherein the brackets are configured to contact each other prior to embracing the post.

8. The system of claim 1 wherein the two brackets comprise a first bracket and a second bracket, a lip of the first bracket overlaps a wall of the second bracket.

9. The system of claim 8 where a lip of the second bracket overlaps a wall of the first bracket.

10. The system of claim 9 wherein the wall of the first bracket has a width substantially longer than a width of the lip of the second bracket.

11. The system of claim 1 further comprising a second fastener at the at least one opening of the second set of openings fastening into and retaining a post, a bottom of the post positioned upon the first fastener, and all of the second set of openings, the second fastener, and the mating brackets second end portion being above grade.

12. The system of claim 1 where the brackets contact each other about the post.

13. A system for bracing a post comprising;

two opposing mating brackets configured to encompass the post between interior surfaces of the brackets, the brackets devoid of projections inhibiting the post from sliding along the interior surfaces, the brackets defining a first end portion and second end portion, and a middle portion disposed between the first and second end portions;

a first set of opposing and alignable openings disposed in the middle portion of the brackets; and a second set of openings disposed near the second end portion of the bracket;

whereby upon mating of the brackets the first set of openings align and oppose each other to allow a first fastener to pass therethrough such that the first fastener is contacted by a terminal surface of the post to be positioned thereon and defining an air column extending from and beneath the first fastener to the first end portion of the mating brackets.

14. The system of claim 13 further comprising a first fastener passing through the first set of openings and a post positioned between the interior surfaces of the brackets, a terminal end of the post contacting the first fastener, the first fastener defining an air column extending from and beneath the first fastener to the first end portion of the mating brackets.

15. The system of claim 13 further comprising a first fastener passing through the first set of openings, the brackets configured to be partially inserted below grade such that the first fastener is positioned below grade while a post having a terminal end in contact with the first fastener projects upward and above grade.

16. A method of erecting a post within ground comprising the steps of:

providing two opposing reciprocally mating brackets configured to encompass the post, the brackets defining a first end portion and second end portion, and a middle portion disposed between the first and second end portions, a first set of opposing and alignable openings disposed in the middle portion of the brackets, a second set of openings disposed near the second end portion of the brackets;

assembling the mating brackets with each other thereby aligning the first set of openings in the middle portion of the brackets;

securing a first fastener within the first set of openings of the brackets;

inserting the assembled brackets into a pre-bored hole in the ground so that the first end portion and first set of openings are below grade, and the second end portion and second set of openings are above grade;

inserting a post within the brackets; and securing the brackets to the post by inserting a second fastener within at least one opening of the second set of openings;

wherein the first fastener supports a bottom surface of the post positioned thereon within the ground and defining an air column extending from and beneath the first fastener to the first end portion of the mating brackets.

17. The method of claim 16 comprising the additional step of securing the brackets within the hole by pouring cement between the ground and the brackets within the hole prior to the step of inserting the post within the brackets.

18. The method of claim 17 wherein the step of pouring cement is performed after inserting the post within the brackets.

19. The method of claim 16 wherein the post is slidable upward from the brackets upon removal of the second fastener.

* * * * *